US006190222B1

(12) United States Patent
Senger

(10) Patent No.: US 6,190,222 B1
(45) Date of Patent: Feb. 20, 2001

(54) THIN ICE INFLATABLE RESCUE LADDER

(76) Inventor: David Senger, 25 Carlin Dr., Lincoln, ND (US) 58504

( * ) Notice: Under 35 U.S.C. 154(b), the term of this patent shall be extended for 0 days.

(21) Appl. No.: 09/443,398

(22) Filed: Nov. 19, 1999

(51) Int. Cl.[7] ..... B63C 9/32
(52) U.S. Cl. ..... 441/82
(58) Field of Search ..... 441/80, 82, 40, 441/84; 244/905, 137.2; 193/25 B

(56) References Cited

U.S. PATENT DOCUMENTS

| | | | | |
|---|---|---|---|---|
| 3,711,879 | | 1/1973 | Siefert . | |
| 3,811,534 | * | 5/1974 | Fisher | 182/48 |
| 4,079,953 | | 3/1978 | Howarth, Jr. . | |
| 4,179,764 | | 12/1979 | Lindblade . | |
| 4,968,046 | | 11/1990 | O'Connell et al. . | |
| 4,990,114 | * | 2/1991 | LeBlanc, Jr. | 441/80 |
| 5,310,229 | | 5/1994 | Hanson . | |
| 5,320,567 | | 6/1994 | Beer . | |
| 5,360,186 | * | 11/1994 | Danielson et al. | 244/137.2 |
| 5,427,557 | | 6/1995 | Lunden, Sr. . | |
| 5,624,292 | | 4/1997 | Wiseman, Jr. . | |
| 5,807,153 | | 9/1998 | Allen et al. . | |
| 5,888,111 | * | 3/1999 | Walker | 441/80 |

* cited by examiner

*Primary Examiner*—S. Joseph Morano
*Assistant Examiner*—Patrick Craig Muldoon
(74) *Attorney, Agent, or Firm*—John D. Gugliotta

(57) ABSTRACT

A rescue ramp is provided having a dual lobed, hinged inflatable ramp having two pairs of spaced inflatable tubes and a flexible floor mounted between each and connecting the tubes. A rope ladder is mounted to the floors of the lobes.

4 Claims, 3 Drawing Sheets

THIN ICE INFLATABLE RESCUE LADDER

BACKGROUND OF THE INVENTION

1. Field of the Invention

This invention relates to a rescue device, particularly to an inflatable rescue ramp for use on thin ice or similar unfirm surfaces.

2. Description of the Related Art

In the related art, it is known that boat rescues of persons or animals in distress can take too much time over a body of water and be even slower over thin ice, increasing the jeopardy and discomfort of such a victim, when, due to problems such as hypothermia, seconds count.

A search of the prior art did not disclose any patents that read directly on the claims of the instant invention; however, U.S. Pat. No. 4,990,114, issued in the name of LeBlanc, Jr. provides an inflatable rescue ramp that forms a lowermost bow element. However, such bow provides and impediment to ingress, making such a ramp difficult for the rescue victim to ascend.

There is, therefore, a need and market for a rescue ramp that is hinged, allowing the lowermost portion to descend into the water toward the rescue victim, as well as provide means for aiding such a victim in exiting the water without forming an impediment to the rescuers.

SUMMARY OF THE INVENTION

Therefore, it is an object of the invention to indicate a device of the type disclosed above which avoids the disadvantages inherent in the state of the art. In particular, the device is to be portable, inflatable, and easy to ascend in a manner that allows rescuer's or the rescued to easily extricate themselves from danger.

It is therefore an object of the present invention to provide an improved thin ice rescue ladder.

It is a feature of the present invention to provide an improved thin ice rescue ladder that includes a support rope to assist in absent.

Briefly described according to one embodiment of the present invention, an inflatable rescue ramp is provided having a pair of spaced inflatable tubes, a flexible web there-between, defining a passageway between said tubes. Within the passageway is mounted a rope ladder element that lies flat against the flexible web. At the lowermost portion is a downwardly angled apron that allows the ramp to descend into a water to allow easy access to and ascent of the ramp.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
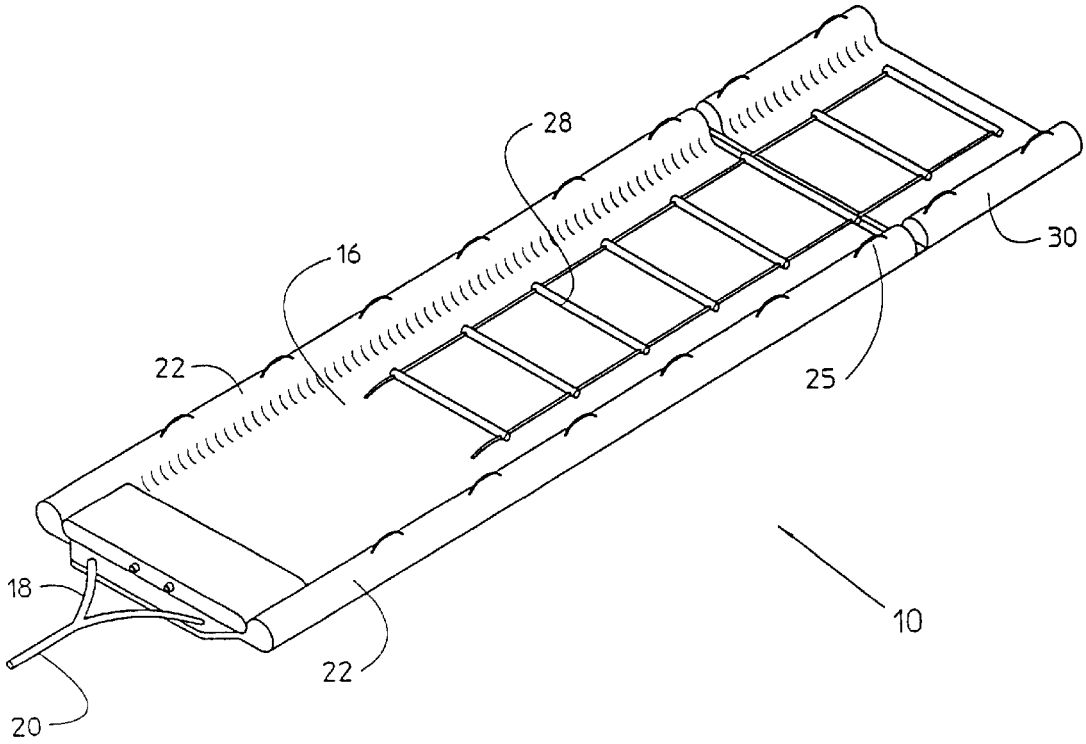
FIG. 1 is a perspective view of a thin ice inflatable rescue ladder according to the preferred embodiment of the present invention.
Figure 2:
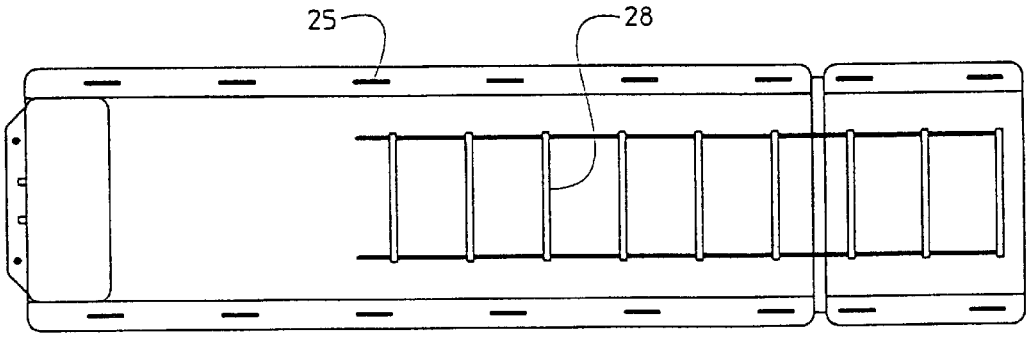
FIG. 2 is a top plan view thereof.
Figure 3:
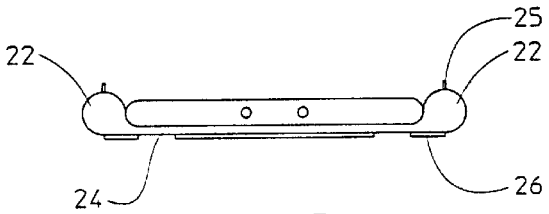
FIG. 3 is a front elevational view thereof.
Figure 4:
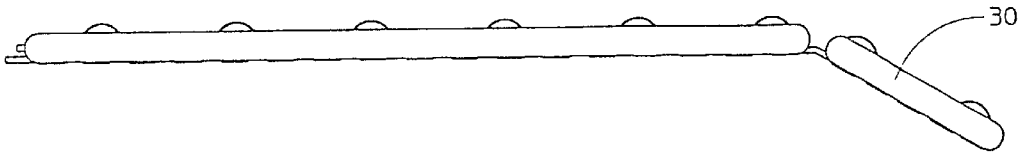
FIG. 4 is a side elevational view thereof.

1. Detailed Description of the Figures Referring now to FIGS. 1–4, a thin ice inflatable rescue ladder 10 is shown, according to the present invention, forming a hinged ramp 16 and further pointed and then secured by anchor lines 18 and 20 to the shore. The ramp 16 is inflatable, and is provided having a pair of spaced inflatable tubes 22, a flexible floor 24 there-between, defining a passageway between said tubes. Linearly aligned along the uppermost ridge of each tube 22 are a series of individual gripping elements 25, shown herein individually as a rope-type loop. On the under surface of the floor 24 is a gripping surface 26 that allows the ramp 16 to assist in maintaining position when deployed upon ice. Within the passageway is mounted a rope ladder element 28 that lies flat against the flexible web. It is anticipated that the ladder element 28 would be mounted only along the lowermost two thirds of the ramp for provided the combined features of providing a gripping and climbing surface for the rescue victim, while at the same time remaining out of the way for the rescuers.

At the lowermost portion of the ramp 16 is a downwardly angled apron 30 that allows the ramp to descend into a water to allow easy access to and ascent of the ramp.

The web or floor of the rescue ramp as well as the inflatable tubes, can be single or multi-ply and made of plastic, rubber or a combination thereof, e.g. a rubber-nylon-rubber laminate is a preferred material for both ramp floor and tubes. By "nylon" is meant a polyamide. If desired an inner tube of rubber or plastic can be placed within the outer plastic inflatable tubes.

The ramp can inflate up to any desired length e.g. 50 feet, 100 feet, 150 feet or more, as desired according to the application within the scope of the present invention.

Figure 5:
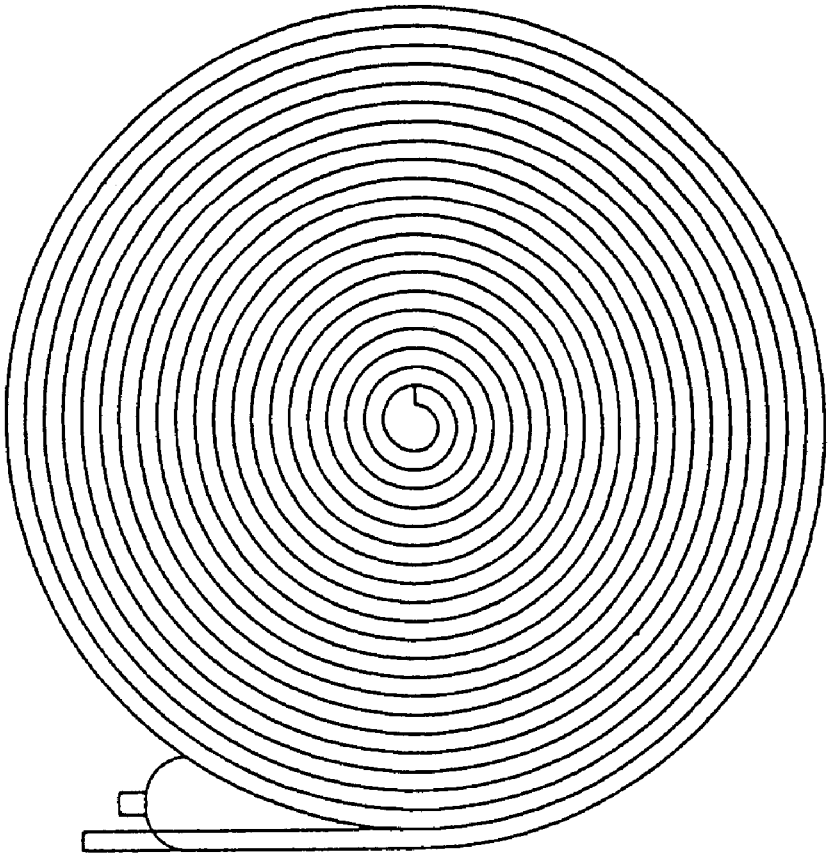
FIG. 5 is a side elevational view thereof shown in a compacted, rolled condition.

As shown in FIG. 5, the inflatable rescue ramp of the present invention can be compacted after deflation, by rolling into an annular shape, or folded into such compact shape as desired, within the present invention. Compressed air bottles, activated by external valves, connects to the two inflatable tubes 22, having the folded web there-between.

The rescue ramp embodying the present invention is inflated by gas, e.g. compressed gas and preferably compressed air. However other gas sources can be employed as desired within the present invention.

The rescue ramp of the invention can inflate front-to-back or back-to-front as desired, within the scope of the invention and preferably inflates back to front.

The rescue ramp of the invention when inflated, is desirably guided, pointed and anchored by a plurality of anchor lines of two or more, though these lines can be dispensed with, within the scope of the present invention.

2. Operation of the Preferred Embodiment

To use the present invention, the coiled ramp is positioned on shore near the water's edge and pointed toward the victim. The valve is then opened and in seconds the ramp tubes are inflated, popping the rescue ramp with web or floor out and toward the victim, to its extended length of e.g. 50 feet, 100 feet, 150 feet or more. The extended ramp 16 thus inflated, is pointed more closely to the victim and the anchor lines 18 and 20 secured as discussed above. The rescuer hurries out to the victim.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A inflatable rescue ramp comprising:

a first pair of spaced inflatable tubes having an inner side;

a flat, flexible first floor connected to each said first tube and having an inner side and an outer side, said first floor extending between said inner sides of said tubes and defining a passageway between said tubes;

a second pair of spaced inflatable tubes having an inner side;

a rope ladder element, said rope ladder element mounted to said first floor and said second floor within said passageway formed between said tubes, wherein said rope ladder element is mounted only along a lowermost portion of the ramp for provided the combined features of providing a gripping and climbing surface for the rescue victim, while at the same time remaining out of the way for the rescuers;

a flat, flexible second floor connected to each said second tube and having an inner side and an outer side, said second floor extending between said inner sides of said second tubes and defining a passageway between said tubes;

and wherein said first floor is linearly aligned with and hingedly affixed to said second floor forming a dual lobed rescue ramp.

2. The rescue ramp of claim 1, wherein each said first tube and said second tube forms and uppermost ridge, said ramp further comprising:

a series of individual gripping elements attached to and extending from said uppermost ridges.

3. The rescue ramp of claim 1, further comprising:

a gripping surface along the underside of said first floor.

4. The rescue ramp of claim 1, in which anchor lines extend on either side thereof for pointing and anchoring said ramp relative to the shore or other support surface.

* * * * *